United States Patent [19]

Corvetto

[11] 4,360,318

[45] Nov. 23, 1982

[54] GAS COMPRESSOR OF THE ROTATING TYPE

[76] Inventor: Andres A. Corvetto, Lavalle 1977, 1° C, Buenos Aires, Argentina

[21] Appl. No.: 149,134

[22] Filed: May 8, 1980

[30] Foreign Application Priority Data

Jul. 11, 1979 [AR] Argentina ..... 277252

[51] Int. Cl.[3] ..... F04C 19/00

[52] U.S. Cl. ..... 417/68

[58] Field of Search ..... 417/68, 69; 418/220

[56] References Cited

U.S. PATENT DOCUMENTS

| | | | |
|---|---|---|---|
| 1,102,222 | 6/1914 | Abbott | 417/68 |
| 1,497,335 | 6/1924 | Johnsten | 417/68 |
| 1,831,336 | 11/1931 | Abbott | 417/68 |

FOREIGN PATENT DOCUMENTS

| | | | |
|---|---|---|---|
| 482644 | 4/1917 | France | 417/68 |
| 702947 | 1/1954 | United Kingdom | 417/68 |

*Primary Examiner*—Carlton R. Croyle
*Assistant Examiner*—Edward Look
*Attorney, Agent, or Firm*—Michael J. Striker

[57] ABSTRACT

A rotary gas compressor has a hollow housing, inner and outer rotors arranged in the housing and provided with a liquid ring therebetween so that rotation of the inner rotor causes rotation of the outer rotor, and the inner rotor is provided with two helical blades guiding gas from the ends to the center of the inner rotor, a speed-varying device having a member which freely rotates over the outer rotor and includes an acceleration tube arranged to receive an incoming fluid and to introduce the same into the liquid ring, and a deceleration tube arranged to receive the fluid outgoing from the liquid ring and to pass the same into the interior of the housing, a filter element separating drops contained in the fluid within the interior of the inner rotor, and an oscillating tube for loading and unloading the compressor by varying the position of the liquid ring.

12 Claims, 8 Drawing Figures

GAS COMPRESSOR OF THE ROTATING TYPE

BACKGROUND OF THE INVENTION

This invention relates to a rotary gas compressor. More particularly, it relates to a rotary gas compressor in which interaction between a helix and a liquid ring takes place for obtaining a compression ratio that is perfectly defined and characteristic for each construction. The use of a fluid as a propelling means is known for rotary compressors with blades or screws. So-called liquid ring compressors are also known. These compressors have various drawbacks. For instance, blade compressors when they have a defined compression ratio for a specific pressure, show wear and tear and a moderate efficiency. The screw compressors in an oil bath require a high speed and present an occasional mixture of the gas with the oil. The liquid ring compressors have a low efficiency and suffer losses by attrition, which are very high and produced by the attrition between said liquid ring and walls of the compressor.

SUMMARY OF THE INVENTION

It is an object of the present invention to provide a gas compressor which has numerous advantages as compared with known gas compressors.

Accordingly, the inventive gas compressor has in combination, a housing accommodating a pair of eccentric rotors including an inner rotor with an input shaft and an outer rotor dragged by the inner rotor through a liquid ring; the inner rotor being provided with a pair of blades that while defining associated gas inlets at the ends thereof are developed approximately as helices and with a spiraloid cross section but in each case in opposite direction towards the rotor half length, wherein their associated final steps have respective communication openings with the interior of the associated rotor; a liquid ring level controlling means comprising a freely rotating member arranged over the outer rotor and provided with elbowed acceleration and deceleration tubes, wherein the acceleration tube acts as a receiver of the incoming fluid and at the same time deposits the same in the liquid ring, and the deceleration tube acts as a receiver for the fluid coming from the liquid ring and impulses the same to the interior of the housing; a coalescence filter is located in the inner rotor as a separator of microdrops contained in the fluid; and an actuating and externally controlled tube is provided in correspondence with two controlling positions of liquid ring level, one of which sets the loading position and the other sets the unloading position of the compressor.

When the compressor is designed in accordance with these features, it provides for advantages in that it does not require mechanical accuracy for its constitutive parts and even less requires radial or axial precision adjustments. It does not show mechanical attrition or wear, with the only exception of the bearings which can be reduced by a respective design of the latter. It does not use valves or friction parts. The compression is nearly isothermic because there is an intimate contact between the gas and the refrigerating fluid, with the consequent improvement in the thermodynamic efficiency. It is capable of producing a steady air flow both during the aspiration and the discharge with the consequent reduction of the operative noise. It has an automatic limitation of the maximum pressure when the pressure value increases above the rated value when the liquid ring is subdued and seals no more, thus overcoming the danger of compressor breakdown and motor failure by overload as occur in other compressors known in the art. It has a low value of automatic starting torque because it starts operation when it reaches certain speed. The losses by viscous friction are considerably reduced, as well as those produced by the impact of the fluid entering the liquid ring. It makes easier the automatic centrifugal separation of the refrigerating fluid carried by the gas. It makes easier the separation of the droplets (aerosols) of the refrigerating fluid with a low pressure drop on account of the coalescence and centrifugal filter that is incorporated in the compressor. Its refrigerating fluid circuit is pressureless so that it enables the use of non-pressurized heat exchangers, and even refrigerating towers in case of water, with attendance cost reduction. Finally, it is easy to regulate by suppressing the compressed gas flow with low power losses.

The above-mentioned and other features and objects of this invention and the manner of attaining them, will become apparent and the invention itself will be best understood by reference to the following description of an embodiment of the invention taken in conjunction with the accompanying drawings.

DESCRIPTION OF A PREFERRED EMBODIMENT

Figure 1:
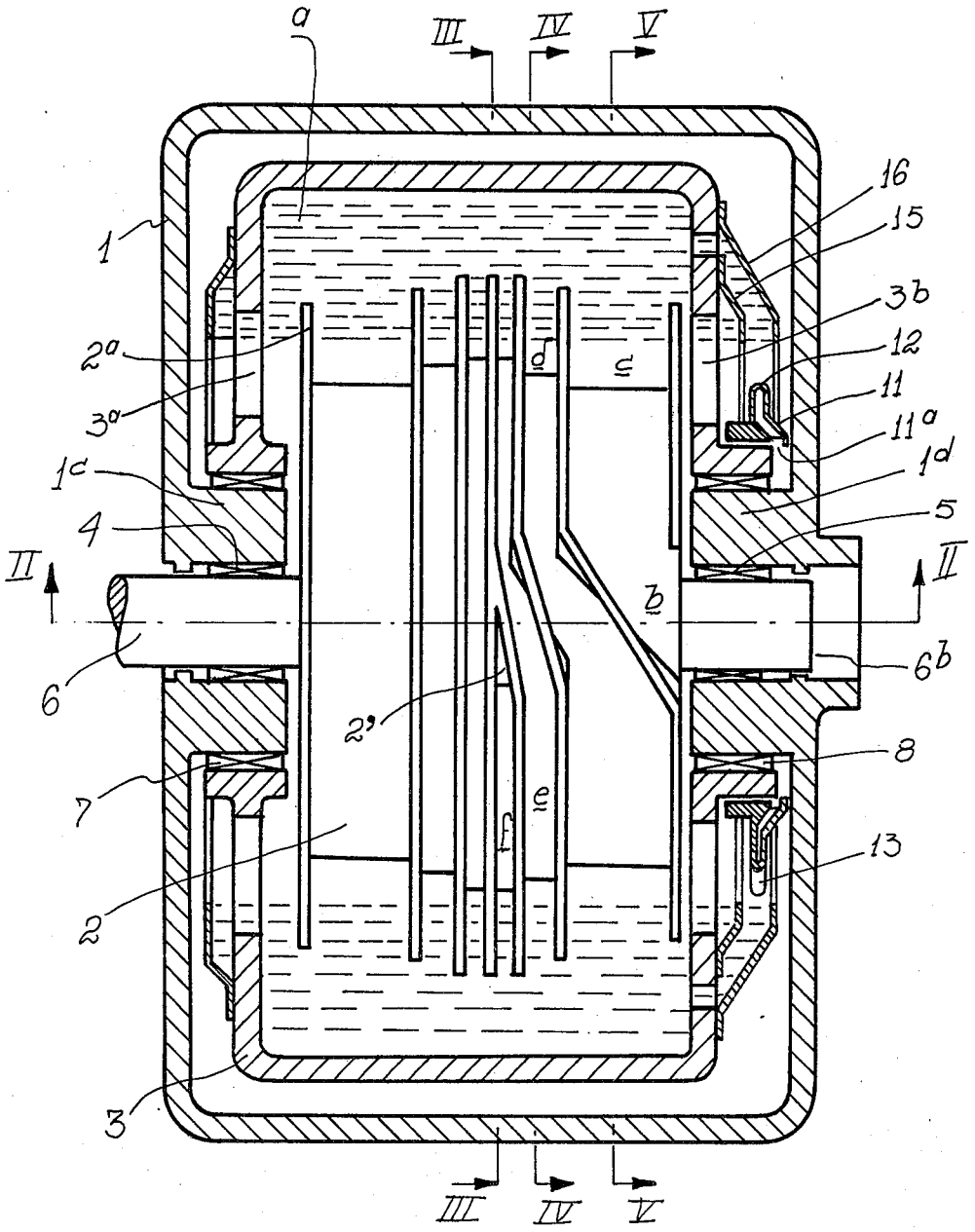
FIG. 1 is a diagrammatic view of the compressor of this invention, in a horizontal section.

A rotary gas compressor in accordance with the invention has a housing 1 provided with gas inputs $\mathbf{1}^a$ and $\mathbf{1}^b$ and forming an enclosure for a pair of rotors 2 and 3. The inner rotor 2 is provided with bearings 4 and 5 and supported by its input shaft 6 on inner pivots $\mathbf{1}^c$ and $\mathbf{1}^d$ of the housing 1. The outer rotor 3 is mounted on the pivots, with interposition of associated bearings 7 and 8, so that it freely and excentrically rotates relative to the inner rotor 2.

The inner rotor 2 is provided with a pair of blades $\mathbf{2}^a$ and $\mathbf{2}^b$, starting at its ends and developing nearly as variable step helices. One of these helices is left handed, and the other helix is right handed until they meet at the center of the rotor length. In a cross section, the same blades appear more or less spiraloid. The number of their turns is fixed as a function of the number of steps which are set for the final compression that, in this embodiment of the invention, equals two. Obviously, only one or more than two steps may be provided, which would only affect the speed of the liquid ring a created between both rotors and which is in turn required to set a given pressure without leaks.

The interior of the inner rotor 2 is divided by a transverse wall $2^c$ into spaces communicating through an opening $2^d$. A coalescence filter 9 is mounted inside the rotor 2 on its shaft 6, adjacent to the transverse wall. A diametral passage $6^a$ is formed in the shaft 6 and communicates with an exit bore $6^b$ also formed in the shaft.

The outer rotor 3, on its front and back faces, has inlet openings $3^a$ and $3^b$. An oscillating actuating tube 10 extends through an opening $10^a$ of the housing 1 and is united with the latter. The tube 10 is adapted to put the compressor out of work. A liquid ring level controlling means 11 is mounted on the outer rotor freely rotating on the other of the openings. It has an elbowed acceleration and deceleration tubes 13, which are respectively arcuated in a direction opposite to the rotation and in the direction of rotation.

Having thus described the compressor of this invention, its operation will be discussed below and in the description of its operation other parts not described before will appear.

The inner rotor 2 is rotated through its input shaft 6 at a speed fixed in accordance with the desired pressure and the number of steps that is required to produce the compression. During its movement and by transmission through the liquid ring a, it also forces the outer rotor 3 to rotate. The outer rotor 3 during its free rotation matches its speed to that of the liquid ring.

The above-mentioned liquid ring a while interacting with the inside rotor 2 promotes the formation of variable spaces for aspiration, compression and exhaust of the gas entering the compressor through the inlet opening $1^a$ and $1^b$ of the housing, the openings $3^a$ and $3^b$ of the outer rotor 3, and b of the inner rotor 2, to the helical space c and in succession, for each turn of the inner rotor, to the helical spaces d, e, and f.

The characteristic compression ratio of the compressor is approximately set by the ratio between the width of the spaces c and f, and the spiral part of the defining blades is progressively introduced into the liquid ring a while the pressure increases, so that the leaks are avoided.

Figure 3:
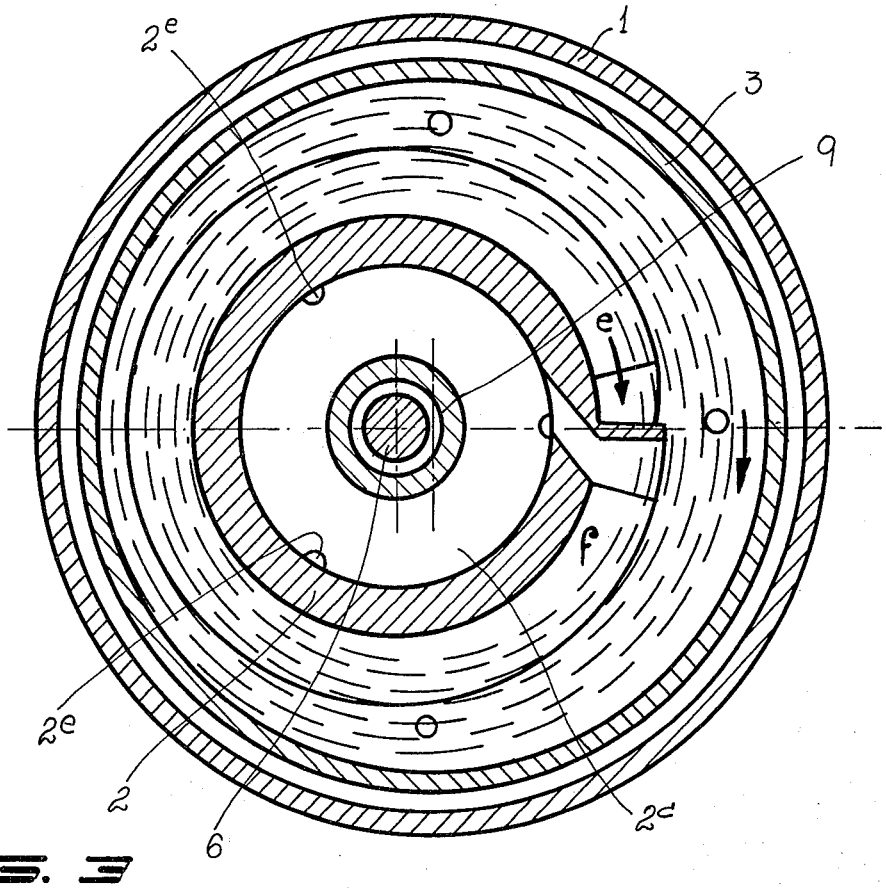
FIG. 3 is a section of the same compressor of FIGS. 1 and 2 taken following the line III—III of FIG. 1 and at a reduced scale.
Figure 4:
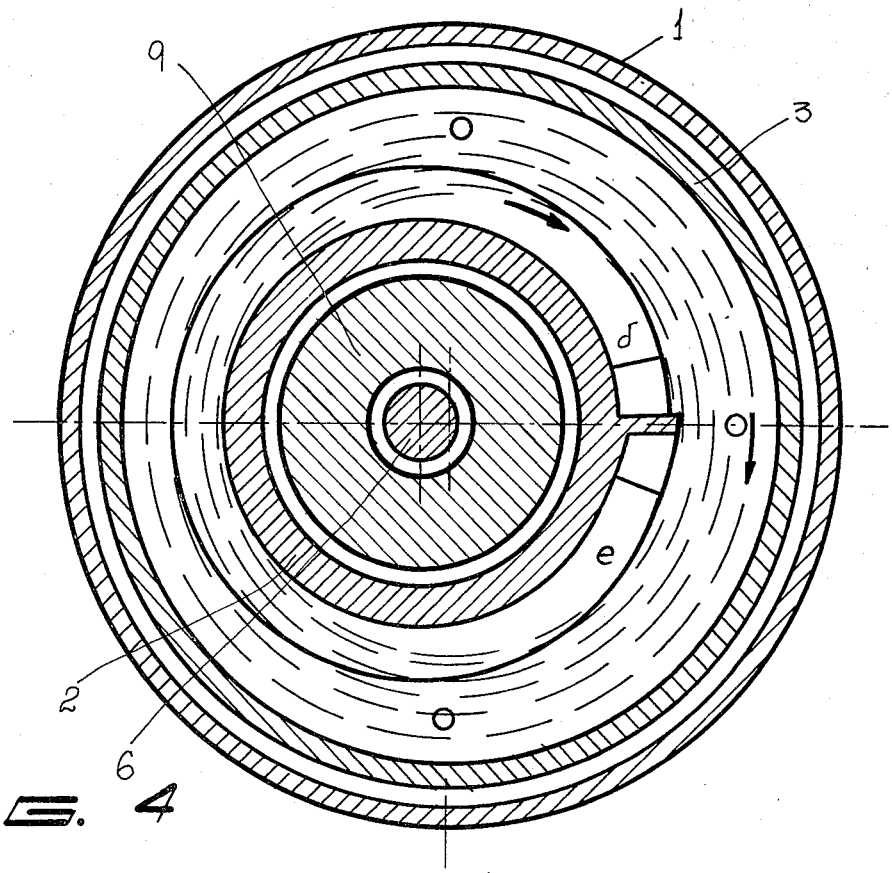
FIG. 4 is another section taken following the line IV—IV of FIG. 1.
Figure 5:
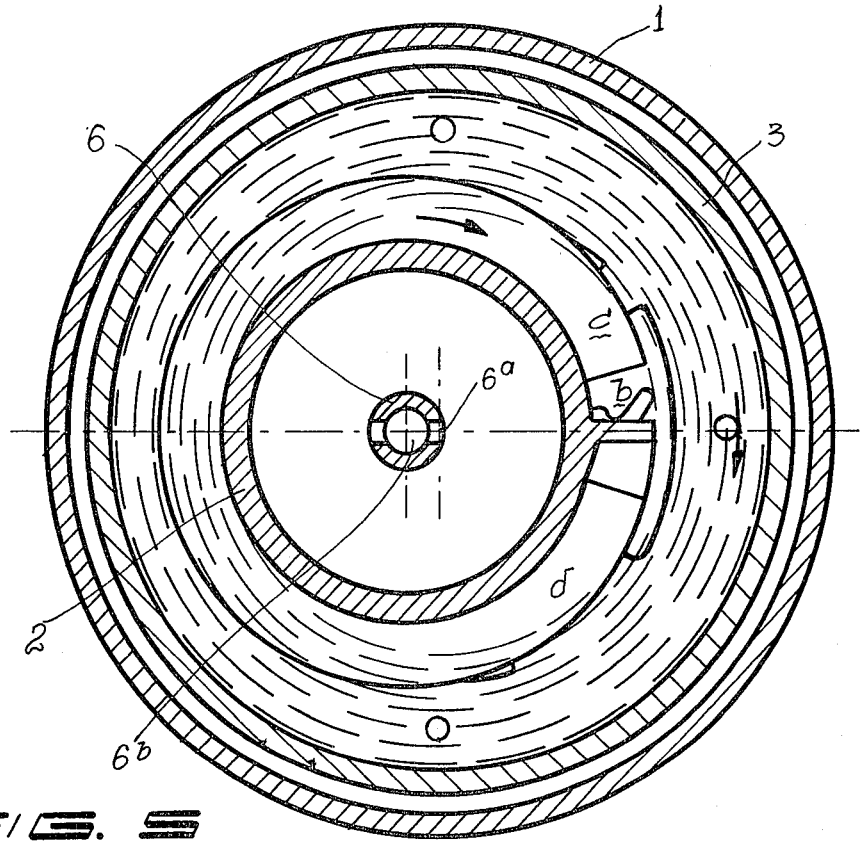
FIG. 5 is a further section taken following the line V—V of FIG. 1.
Figure 6:
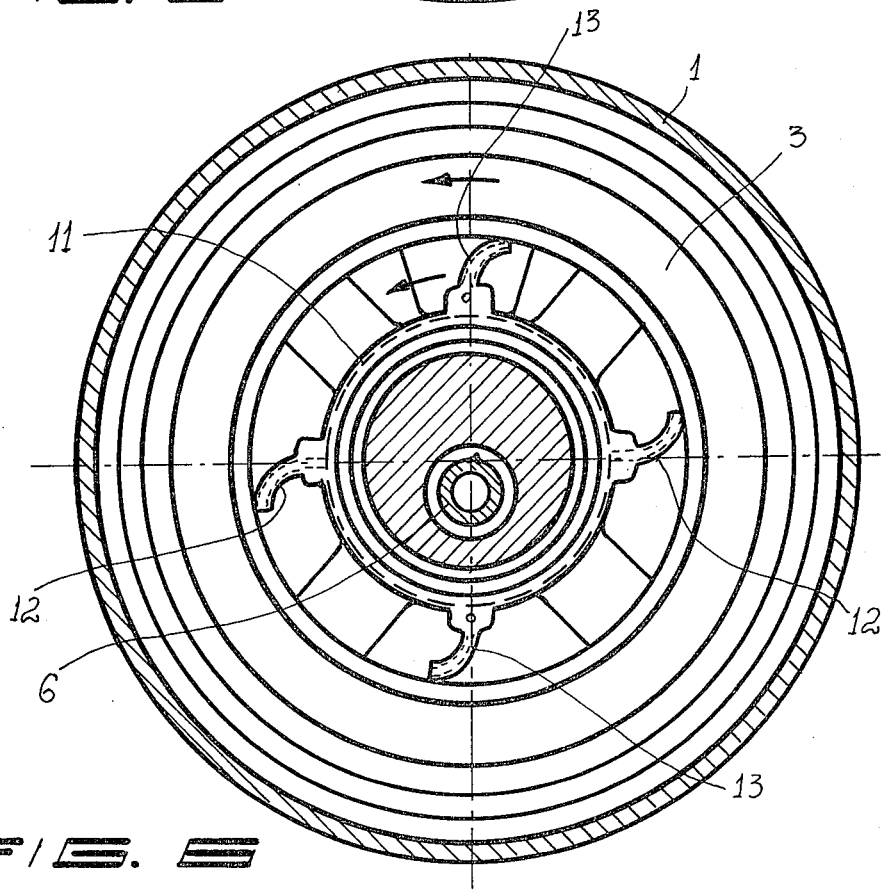
FIG. 6 is still another section taken following the line VI—VI of FIG. 2.
Figure 8:
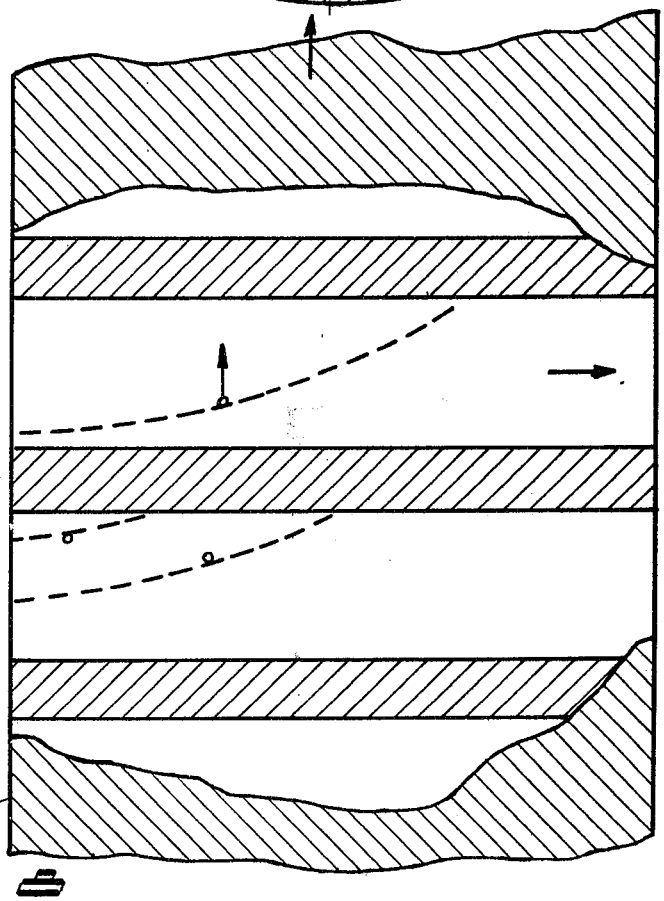

Gas in the space f passes through an opening 2' of the inner rotor 2 (FIG. 3) and reaches an inside space 2'' of the inner rotor where it is radially and slowly displaced so as to promote the separation of the refrigerating fluid drops carried by the centrifugal force. The gas goes then through the coalescence filter 9 which, as shown in detail by FIG. 8, is provided with openings markedly greater than the droplets to be separated, thus producing a low pressure drop. Besides, the capacity of this filter to separate the droplets is due to the fact that the gas is displaced at right angles to the action of the centrifugal forces and in such a way that each opening or passage of the filter acts as a decanter so that the droplets, by coalescence, should be absorbed by the filtering means. The latter by capillarity and centrifugal acceleration, carries the droplets to the filter periphery wherefrom they pass to the inside wall of the rotor 2 passing through the radial openings $2^e$ until they reach the opening 2' and from it the liquid ring a. Finally, and after passing through the coalescence filter 9, the gas leaves the compressor through the passage $6^a$ and the bore b*b* of the shaft 6 of the inner rotor 2.

It should be noted that the above description of the operation of the compressor according to this invention relates to one half of the same and more particularly referring to the illustrated embodiment, it relates to the right half of the compressor. Just the same happens in the left half, taking on account that the compressed gas reaches the inner space 2'' of the inner rotor 2 which is in this case a common rotor defining its blades $2^a$ and $2^b$.

It should be noted also that the helices are displaced by 180° so that the resultant flux is constant both for the discharge and for the aspiration. While in the present embodiment of the invention a discontinuous variable pitch is mentioned, it may also be continuous.

With reference to the refrigerating fluid, it enters the compressor through a hole $1^c$ of the housing 1 to be collected by a channel $11^a$ provided by the device 11 having a lower rotating speed than the outer rotor 3. From this channel the refrigerating fluid enters, under the action of the centrifugal force, the elbowed tubes 12 of the device where it is accelerated until it is transferred to the liquid ring a at about the same tangential speed.

Figure 2:
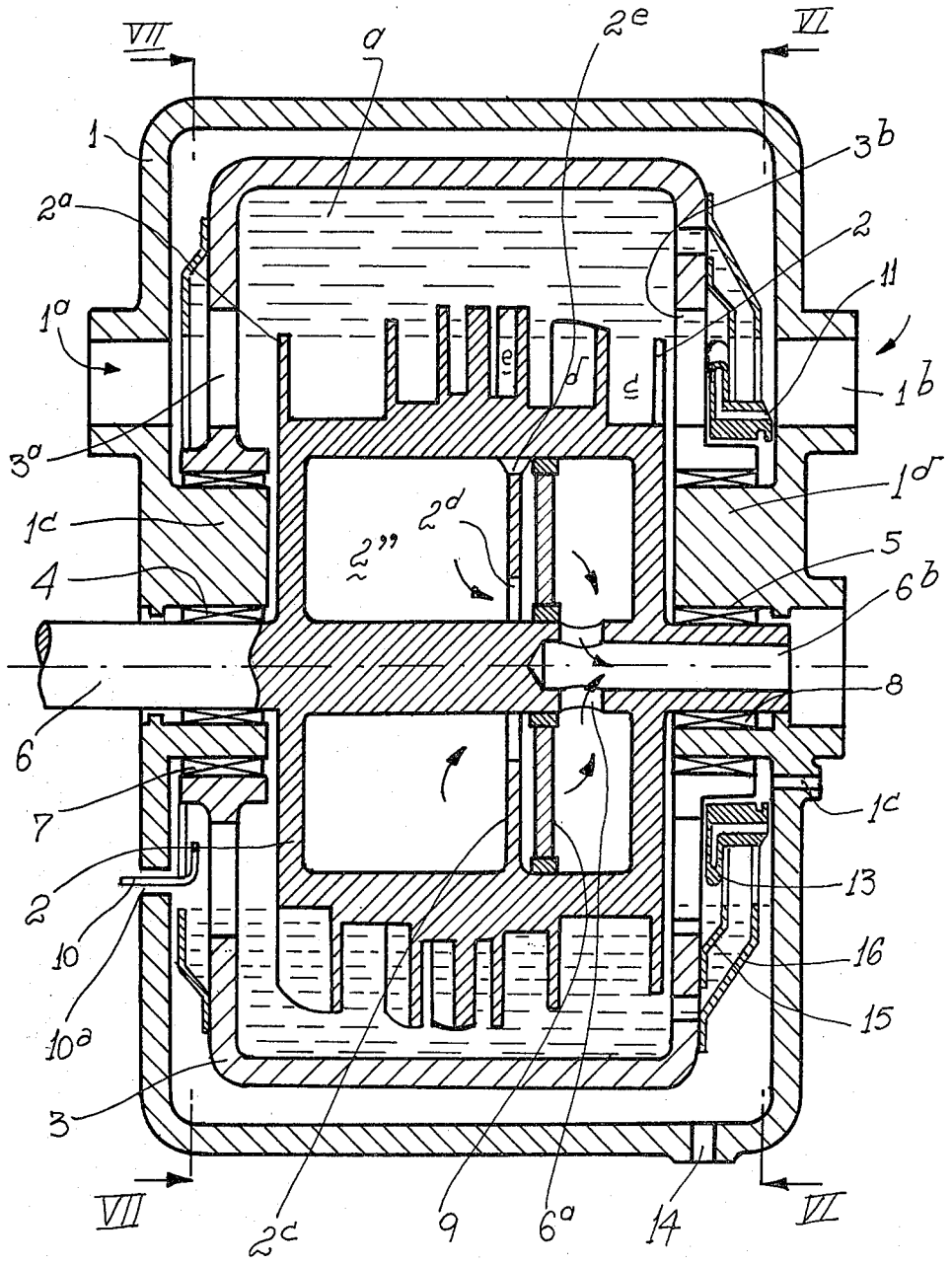
FIG. 2 is a section of the same compressor of FIG. 1 taken following the line II—II of FIG. 1.

As shown in FIG. 1, the refrigerating fluid enters into the inner rotor 2 at its periphery and after circulating in the liquid ring is taken by the elbowed tubes 13 of the device 11 to be decelerated and impulsed into the housing 1 from which it is exhausted through a hole 14, as shown in FIG. 2.

The obvious conclusion is that the liquid ring level controlling means 11 has two functions: i.e., to keep the proper level of the liquid ring a and to give to the inlet fluid the kinetic energy of the exhaust fluid, to reduce the losses by fluid acceleration. Plates 15 and 16 are provided to avoid mixture between the lower temperature inlet fluid and the higher temperature exhaust fluid.

Figure 7:
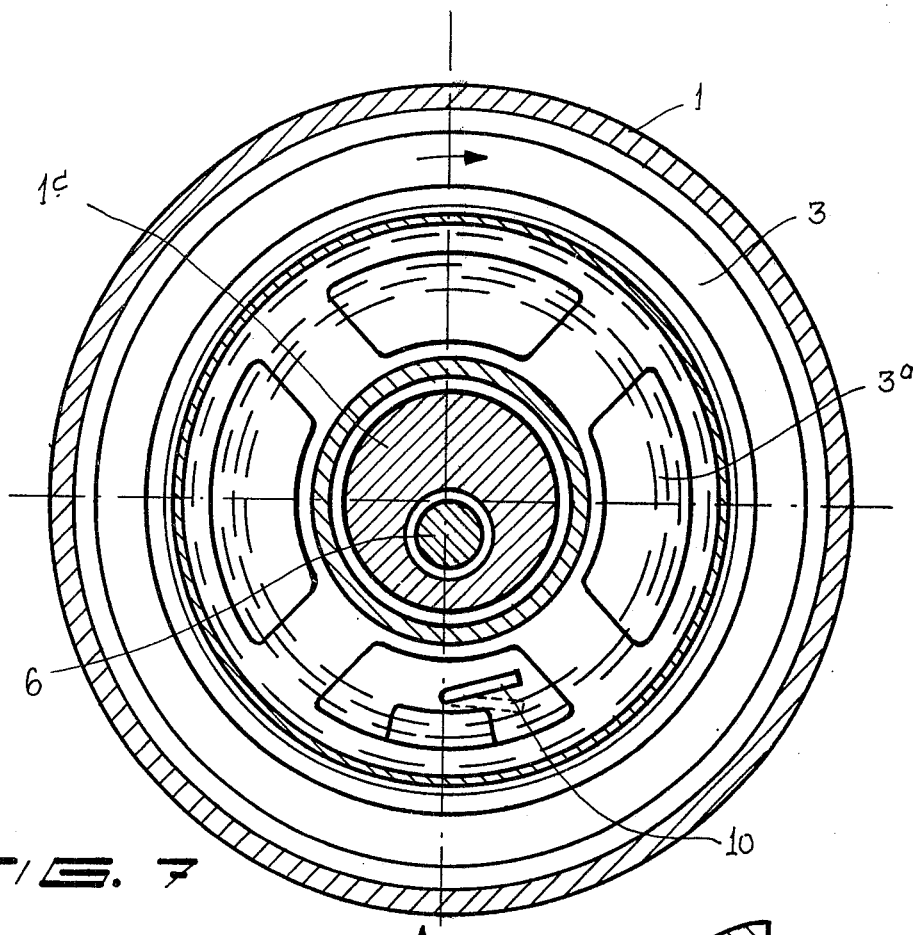
FIG. 7 is still a further section taken following the line VII—VII of FIG. 2; and, FIG. 8 is a fragmentary detailed view of a coalescence filter.

To put the compressor out of operation, it is required to place the actuating tube 10 in the position shown with dashed lines in FIG. 7. In this way, after draining, it so changes the level of the liquid a that the latter no longer seals the inner rotor 2, so that it does not aspirate or compress the gas any more.

It will be understood that each of the elements described above, or two or more together, may also find a useful application in other types of constructions differing from the types described above.

While the invention has been illustrated and described as embodied in a rotary gas compressor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without emitting features that, from the standpoint of prior art, fairly constitute essential characteristics of the generic or specific aspects of this invention.

What is claimed as new and desired to be protected by Letters Patent is set forth in the appended claims:

1. A rotary gas compressor, comprising a hollow housing; a hollow inner rotor arranged in said housing and rotatable about an axis, said inner rotor having two axial ends, a central region between said axial ends, and an the exterior and interior of said inner rotor, said inner rotor having two outer blades which are formed substantially as oppositely wound helices and each extend from a respective one of said axial ends to said central region and thereby to said opening, so that gas enters each of said blades at a respective one of said axial ends, travels along each of said blades, and exits the latter into the interior of said inner rotor through said opening; a hollow outer rotor arranged in said housing and eccentrically surrounding said inner rotor with the interposition of a liquid ring, so that said outer rotor rotates in response to the rotation of said inner rotor via said liquid ring; liquid ring level controlling means having a member which freely rotates over said outer rotor and includes acceleration and deceleration tubes, said acceleration tube being arranged to receive an incoming fluid and to introduce the same into said liquid ring, whereas said decelerating tube is arranged to receive the fluid outgoing from said liquid ring and to pass the same into the interior of the housing; means for separating microdrops contained in said fluid, in the interior of said inner rotor; and means for loading and unloading the compressor by varying the position of said liquid ring.

2. A rotary gas compressor as defined in claim 1, wherein said housing supports said inner and outer rotors; and further comprising means for supporting said inner and outer rotors in said housing.

3. A rotary gas compressor as defined in claim 2, wherein said inner rotor has a driving shaft arranged to drive the same in rotation, said supporting means including a pair of pivots provided in said housing and supporting said driving shaft of said rotor.

4. A rotary gas compressor as defined in claim 3, wherein said pivots have inner surfaces on which said driving shaft of said inner rotor is rotatably supported, and outer surfaces on which said outer rotor is rotatably supported.

5. A rotary gas compressor as defined in claim 1, wherein said separating means includes a coalescence filter located in the interior of said inner rotor.

6. A rotary gas compressor as defined in claim 1, wherein said loading and unloading means includes a tube which provides for two different controlling positions of the level of said liquid ring so that one of said positions causes loading of the compressor whereas the other of said positions causes unloading of the latter.

7. A rotary gas compressor as defined in claim 6, wherein said tube of said loading and unloading means is an oscillating externally controlled actuating tube arranged to be connected with and to be disconnected from said liquid ring.

8. A rotary gas compressor as defined in claim 1, wherein said rotor has a driving shaft arranged to drive the same in rotation, said driving shaft being provided with a through-going hole which communicates with the interior of said inner rotor so that gas can exit from the latter through said through-going hole.

9. A rotary gas compressor as defined in claim 1, wherein said tubes of said liquid ring level controlling means are formed as elbowed tubes.

10. A rotary gas compressor as defined in claim 1, wherein said accelerating tube and said decelerating tube of said liquid ring level controlling means are arched in direction of rotation and in a direction opposite to the direction of rotation of said members, respectively.

11. A rotary gas compressor as defined in claim 1, wherein said incoming fluid and said outgoing fluid are at different temperatures; and further comprising means for preventing mixing of said incoming fluid with said outgoing fluid.

12. A rotary gas compressor as defined in claim 1, wherein said preventing means includes a pair of plates.

* * * * *